US005743676A

United States Patent [19]

Hans-Juergen et al.

[11] Patent Number: 5,743,676

[45] Date of Patent: Apr. 28, 1998

[54] METHOD AND DEVICE FOR KEEPING OUTFALL DRAINAGE IN SERVICE DURING SEWERAGE CONSTRUCTION

[75] Inventors: John Hans-Juergen, Hamburg; Guenter Geschke, Seevetal; Gerhard Rade, Jork, all of Germany

[73] Assignee: Meyer & John GmbH & Co Tief- und Rohrleitungsbau, Germany

[21] Appl. No.: 619,320

[22] Filed: Mar. 21, 1996

[30] Foreign Application Priority Data

Mar. 29, 1995 [DE] Germany ..... 195 13 047.2

[51] Int. Cl.[6] ..... F16L 1/028

[52] U.S. Cl. ..... 405/184; 405/141; 405/174

[58] Field of Search ..... 405/184, 178, 405/174, 154, 141, 146, 150.1

[56] References Cited

U.S. PATENT DOCUMENTS

| | | | |
|---|---|---|---|
| 3,762,174 | 10/1973 | Fikse et al. | 405/184 |
| 4,874,268 | 10/1989 | Akesaka | 405/184 |
| 5,061,120 | 10/1991 | Akesaka | 405/184 X |
| 5,505,558 | 4/1996 | Brown | 405/184 |
| 5,632,574 | 5/1997 | Klaymar et al. | 405/154 X |

FOREIGN PATENT DOCUMENTS 2 130 625 A 6/1984 United Kingdom .

OTHER PUBLICATIONS

Karnath: "Neuer Kanal im schmalen Schlitz," *bd baumaschinendienst*, Oct. 1994, pp. 836–840.

*Primary Examiner*—Tamara L. Graysay
*Assistant Examiner*—Frederick L. Lagman
*Attorney, Agent, or Firm*—Nixon & Vanderhye

[57] ABSTRACT

In a method for keeping outfall drainage in service whilst constructing sewerage, wherein a main drain is laid in the position of an old drain or in a new line by pipe or shield tunnelling under closed or semi-open construction using a working pipe or shield (1) at the tunnelling end (9), at essentially the same time as the working pipe or shield (1) is tunnelling, at least one outfall drain (30) is laid below ground through at least one working orifice (20) in the working pipe or shield (1), so that the outfall drain (30) lies alongside the main drain. A device suitable for implementing the method has a working pipe or a shield (1) with at least one working orifice (20) for laying at least one underground outfall drain (30) alongside the main drain from the interior of the working pipe or shield (1).

16 Claims, 1 Drawing Sheet

Figure 1:
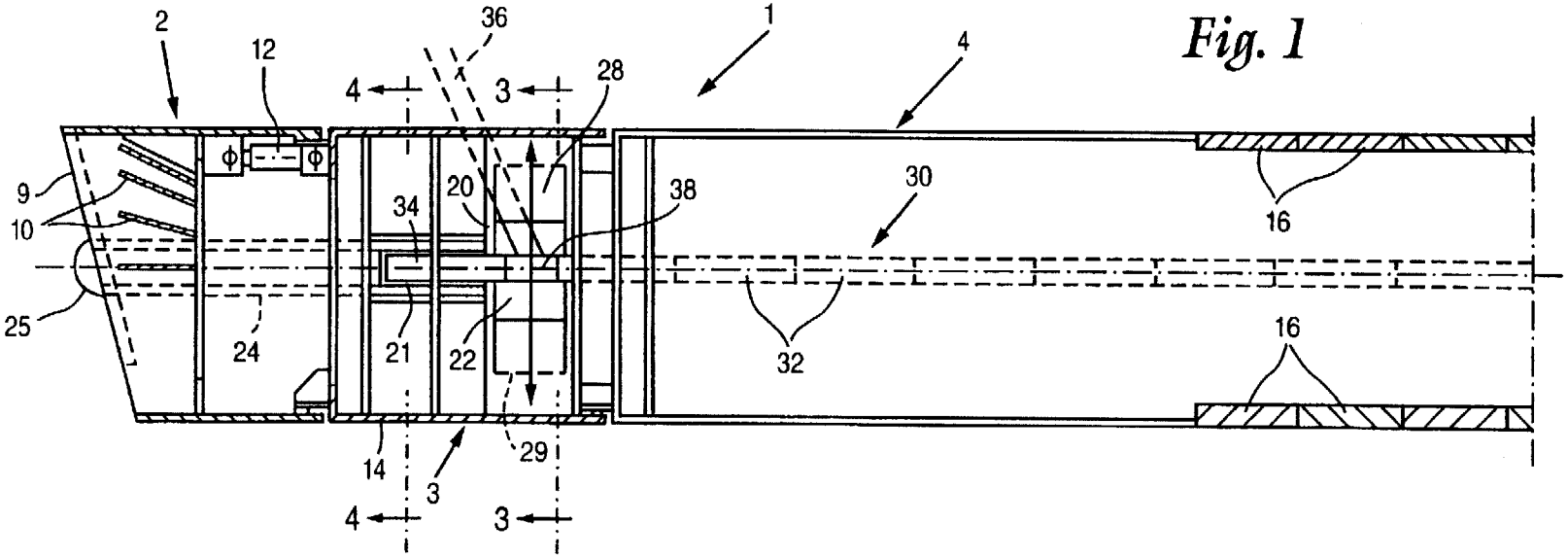

METHOD AND DEVICE FOR KEEPING OUTFALL DRAINAGE IN SERVICE DURING SEWERAGE CONSTRUCTION

The invention relates to a method and a device for keeping outfall drainage in service during sewerage construction, wherein a main drain is laid in the position of an old drain or along a new line by means of pipe or shield tunnelling under closed or semi-open construction using a working pipe or shield at the tunnelling end.

It is known that sewerage can be reinstated in a manner that allows outfall drainage to be maintained during construction work, i.e. during this period, soil water feeding into the drainage system through feeder pipes, such as house discharge pipes, can be drained. In the known methods, pipe or shield-tunnelling equipment is passed through the old drain under closed or semi-open construction. In the case of pipe tunnelling, drain pipes are driven forwards in the location of the old drain (or possibly along a new line) from a stationary excavation and a working pipe is used at the front end to facilitate tunnelling. In the case of shielded tunnelling, a shield, whose direction of movement is preferably controllable, is moved forward along the desired line. Earth or debris from the old drain can be removed from the front face of the shield and transported away. The drain is constructed behind the shield, e.g. by means of tubbing. To avoid having to take the resident systems or the various feeder or discharge pipes connected into the old drain out of service during the construction period, it is common to provide an excavation adjacent to the main line for the new drain (referred to hereafter as main drain). The feeder or house discharge pipes are exposed in this excavation, opened and fed into to a pump sump. Pumps with float switches are generally installed in the pump sump, which catch oncoming soil water from the feeder pipes or house discharge pipes, pump it to the surface and convey it via an auxiliary pipeline above ground to the next drain that is in service. Under certain circumstances, inspection chambers or manholes may be used to gain access to house discharge pipes. Thus, in the known methods, the feeder or house discharge pipes are intercepted and the soil water is removed above ground.

One disadvantage of the known method is that an open excavation has to be prepared for each feeder pipe, which is costly and detrimental to the ecological balance of the construction operation as a whole. In addition, the auxiliary lines above ground are unsightly.

The objective of the invention is to provide a way, when renewing drainage systems, for accessing the feeder pipes below ground and keeping them in service during construction works, even if the main drain is to be constructed by one of the methods mentioned above.

The objective is achieved by a method and a device for keeping outfall drainage in service whilst building drainage systems, having the features set out in claims 1 or 8. Advantageous embodiments are set out in the dependent claims.

With the method of the invention, at essentially the same time as the working pipe or shield is tunnelling, at least one outfall drain is laid underground through at least one working orifice in the working pipe or shield, so that the outfall drain lies alongside the main drain. The outfall drain will be used for the soil water from existing feeder pipes. Existing feeder pipes can be connected below ground to the outfall drain laid below ground by means of the working orifice so that as a general rule there is no need to provide an open excavation for this purpose, which reduces costs, improves the ecological balance of the construction works as a whole and reduces inconvenience to residents.

To this end, when a feeder pipe is encountered, the feeder pipe is preferably disconnected from its present outfall point (in the old drain) and connected via a branch element to the stretch of outfall drain already laid. At least some and preferably all of the work required for this purpose is carried out from the interior of the working pipe or shield and is so by means of the working orifice and, if necessary, additionally also through orifices provided in the front face of the working pipe or shield.

The feeder pipe can be temporarily shut off for a period during the connection operation if necessary and also as a way of preventing any infiltration of earth. As a general rule, however, this is only necessary over a short period and in this case circumstances may even allow the systems feeding into the feeder pipes to remain in service, since the upper portion of the feeder pipe as well as the pipework installed in buildings, for example, have a certain capacity to hold soil water. In many cases, therefore, residents may not even realise that sewerage is being renovated in their street.

Preferably, the cavity in the earth required for the outfall drain is formed as the working pipe or shield tunnels forward by means of a lateral protrusion on the working pipe or shield. A protective casing may serve as the lateral protrusion, which surrounds the outside of a laying orifice provided in the side wall of the working pipe or shield and is closed in the tunnelling direction and open in the direction opposite the tunnelling movement. With this embodiment, a length of outfall pipe that has to be laid can be passed from the interior of the working pipe or shield through the laying orifice and moved through the open end of the protective casing onto the stretch of outfall piping already laid. If the working pipe or shield is provided with lateral protrusions for forming a cavity in the ground, there is no need to prepare a seaprate line for the outfall drain. Constructing the protrusions in the form of protective casings has the advantage that no undesirable debris can get through the laying orifice into the interior of the working pipe or shield, since the only opening onto the earth is located on the end of the protective casing facing away from the tunnelling direction.

The drain pipe may be made from lengths of substantially rigid pipe, preferably with standard fittings in conventional materials. With its front end pointing in the tunnelling direction, the length of pipe to be laid can therefore be connected onto the stretch of outfall piping already laid by its rear end through the working orifice.

The drain line may also be designed as flexible endless pipe. In this case, the endless pipe to be laid is bent back in the interior of the working pipe or shield and, with its free end pointing away from the tunnelling direction, fed through the working orifice and connected onto the stretch of outfall piping already laid.

In both instances, the drain can be laid rapidly and safely, even if space in the interior of the working pipe or shield is restricted.

The device of the invention has a working pipe or a shield with at least one working orifice for laying at least one underground outfall drain alongside the main drain from the interior of the working pipe or shield.

As already mentioned, in order to produce the required cavity in the ground for the outfall drain as the working pipe or shield is tunnelling, the working pipe or shield may be provided with a lateral protrusion, which may be designed as a protective casing. In this case, the laying orifice at the protective casing is preferably a slit running along the longitudinal direction of the working pipe or shield. Pipe sections of the outfall drain to be laid or, alternatively, the turned back end region of a flexible endless pipe designed for outfall pipework can be readily inserted through the slit into the protective casing and then moved through the open end of the protective casing in what is already the largely correct alignment onto the end of the stretch of outfall drain already laid.

In one preferred embodiment, the working orifice also has a fitting orifice in the side wall of the working pipe or shield, which is adjacent to the end of the laying orifice that is pointing in the direction opposite tunnelling. The fitting orifice is preferably closeable, e.g. by means of a double slide device mounted on the interior wall of the working pipe or shield that can be moved transversely relative to the tunnelling direction. Through the fitting orifice, work can be carried out from the interior of the working pipe or shield in the adjacent area underground, e.g. fitting lengths of outfall pipe or connection work on a feeder line.

Preferably, underground outfall drains are laid on both sides of the main drain, e.g. where house discharge lines feed into the drainage system from both sides of a residential street. The requisite working orifices are then provided on both sides of the lateral wall of the working pipe or shield.

Figure 4:
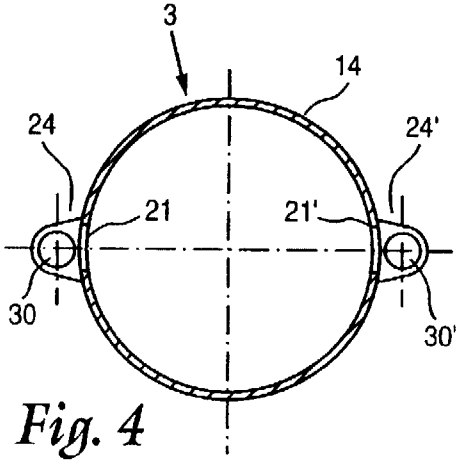
Figure 3:
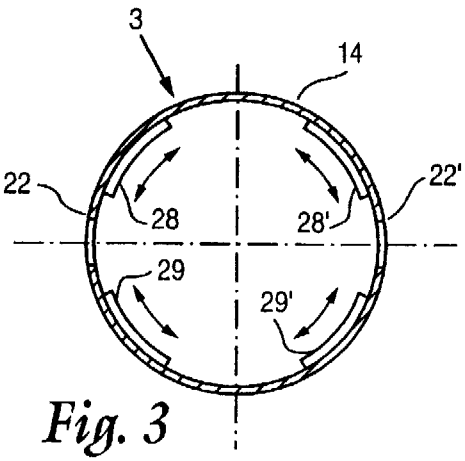
Figure 2:
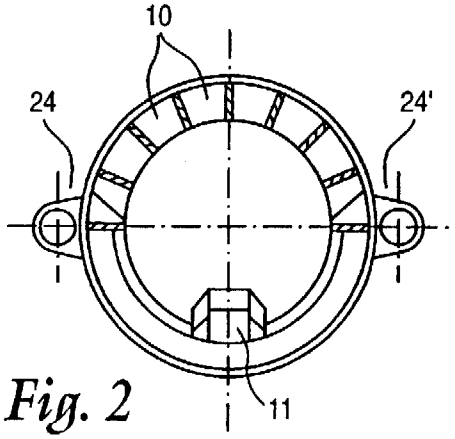

The invention is described below in more detail with reference to an embodiment. The drawings show in:

FIG. 1 a longitudinal view of a shield, partially in section, for producing a channel using the shield tunnelling method, which enables two underground outfall drains to be laid alongside the main drain, FIG. 2 a front view of the shield of FIG. 1, FIG. 3 a cross-section through the shield of FIG. 1 along the line A—A, and FIG. 4 a cross-section of the shield of FIG. 1 along the line B—B.

The invention will be explained using the specific embodiment with reference to a shield tunnelling method. However, it may, of course, be applied to a pipe tunnelling method, as will be clear to the skilled person from this embodiment. In pipe tunnelling, a working pipe is used instead of a shield, which, like the shield, is provided with at least one working orifice for laying an outfall drain (see below).

FIGS. 1 to 4 illustrate various views of a shield 1. The shield 1 essentially consists of a cutting shoe 2, a laying device 3 and a machine pipe 4.

In the illustration of FIG. 1, a new drain (main drain) is to be constructed in the line of an old drain. To this end, the shield 1 is moved forwards to the left, destroying the old drain whilst the main drain is built at the rear end of the shield 1 (right).

Cutting members 10 are provided in the area of the tunnelling end 9 of the cutting shoe 2. FIG. 2 shows a mechanism 11 for breaking, picking up and removing cuttings (such as earth and parts of the old drain) in the front end region. The cutting shoe 2, which has an essentially cylindrically shaped casing, is movably connected to the laying device 3. Hydraulically driven control cylinders 12 actively allow the cutting shoe 2 to be steered relative to the laying device 3. The laying device 3 has an essentially cylindrically shaped casing 14, the external diameter of which approximately matches that of the casing of the cutting shoe 2. The joint between the laying device 3 and the machine pipe 4, whose external diameter approximately matches that of the laying device 3, is movable. If necessary, e.g. if the shield is required to move across lines with tight radial curvatures, it is recommendable to provide control cylinders on this joint too.

In the interior of the machine pipe 4 are control and drive mechanisms, which are not shown in FIG. 1, such as, for example, tunnelling presses for moving the cutting shoe 2 forward. Conveyor mechanisms are also assembled here to remove the cuttings through the main drain already constructed. In the embodiment described, the main drain is extended using tubbings 16 on the rear end (right) of the machine pipe 4.

The cutting shoe 2 as well as the machine pipe 4 are of conventional construction. Multi-part shields 1 are also known, in which an additional pipe-shaped member (corresponding to the laying device 3) is inserted by means of hinge-joints between the cutting shoe 2 and the machine pipe 4. The interior volume of the shield 1 is accessible.

Whereas with conventional shields 1 the cutting shoe 2 is directly adjacent to the machine pipe 4, in the invention, the laying device 3 is incorporated at this point. The laying device will be described in more detail below.

In the casing 14, in its side wall, is a working orifice 20. A similar working orifice 20' is provided on the opposite side of the laying device 3 (see FIG. 3 and FIG. 4). The working orifice 20 has two areas that merge with one another, these being a laying orifice 21 and a fitting orifice 22. (Alternatively, these openings 21, 22 may be separate from one another). The laying orifice 21 is a slit running in the longitudinal direction of the shield 1. A length of outfall pipe to be laid can be taken out through this (see below) from the interior of the laying device 3. The fitting orifice 22, which adjoins the rear end of the laying orifice 21, is wider than the laying orifice 21, allowing fitters to reach through it in order to carry out work from the interior of the laying device 3 on the exterior thereof.

On the outside, the laying orifice 21 is surrounded by a protective casing 24 (see also FIG. 4). The protective casing 24 is rigidly joined to the casing 14 of the laying device 3 and extends as a pipe-like body closed on all sides beyond the laying device 3 as far as the tunnelling end 9 of the cutting shoe 2. The protective casing 24 is closed here, i.e. in the tunnelling direction and, in the embodiment described, by means of a semi-spherical cap, see FIG. 1. The rear end of the protective casing 24, which is located more or less at the point where the laying orifice 21 and the fitting orifice 22 merge, is open. As the shield 1 is driven forwards, the region at the front end 25 of the protective casing 24 produces a cavity and the earth pushed aside is picked up by the cutting shoe 2. No earth can penetrate at the rear end of the protective casing 24. On the side of the shield 1 lying opposite the protective casing 24, is a similarly constructed protective casing 24' (see FIG. 2 and FIG. 4).

If it is required to be able to pivot the cutting shoe 2 over a greater angle relative to the laying device 3 by means of the control cylinders 12, it is of advantage to construct each of the protective casings 24 and 24' in two parts. In this case, the front part is connected to the cutting shoe 2 so that it can pivot therewith, whilst the rear part is mounted on the laying device 3; a joint allowing a pivoting movement is fitted in between.

The fitting orifice 22 can be closed by means of a double slide device. The double slide device consists of an upper slide member 28 and a lower slide member 29, which are mounted on the interior wall of the laying device 3 and can be moved transversely relative to the tunnelling direction of the shield 1. The curvatures of the upper slide member 28 and the lower slide member 29 match the curvature of the casing 14. The fitting orifice 22' can be closed by means of similarly constructed slide members 28' and 29'. The arrows in FIG. 1 and FIG. 3 indicate the direction of movement of the slide members 28, 29, 28', 29'. When the shield 1 is tunnelling, it is recommended that the slide members 28, 29, 28', 29' be kept closed to prevent earth from getting in. They are opened in order to carry out assembly work on the outside.

A description will be given below of how the device is applied, in order to implement the method of the invention using the embodiment.

As mentioned above, the shield 1 illustrated in FIG. 1 moves from right to left, in order to clear (pass over) an old drain located to the left of the cutting shoe 2 and permit construction of a new drain (main drain) to the right hand side, in this instance using tubbings 16.

During construction work, the old drain for the residents remains in service. By means of existing feeder pipes or house discharge pipes feeding into the old drain, soil water is drained or pumped away through the old drain. The stretch under construction, however, is not suitable as a link between two drains for carrying larger quantities of drainage.

No drainage can be fed through the region of the main drain during construction work. Therefore the feeder pipes in the region of the main drain are connected to an outfall drain 30, which, for the purposes of the invention, is laid below ground alongside the main drain. Since a street usually has buildings on both sides, it is recommendable to provide an outfall drain on both sides of the main drain. In the described embodiment, these are shown as outfall drain 30 and the similarly constructed outfall drain 30' (see FIG. 4).

The outfall drain 30 is made up of individual pipe lengths 32, which are fitted and sealed together. The pipe lengths 32 are generally rigid standard fittings and are made from a material conventionally used in drainage construction.

The outfall drains 30 and 30' are extended by shield tunnelling. If no house discharge pipes need to be connected to the outfall drains 30 or 30', new pipe lengths 32 are added to the stretch of outfall piping 30 or 30' already laid. This is done as follows: The slide members 28, 29, 28', 29' remain closed whilst the shield 1 is moving. The protective casings 24 and 24' thus produce the requisite cavities in the ground. After a stretch corresponding to the length of a pipe section 32 or somewhat bigger has been covered, the pipe length 34 to be laid is inserted via the laying orifice 21 into the interior of the protective casing 24 and pushed through the open end thereof onto the stretch of pipework already laid, in this case outfall piping 30. Once the upper slide member 28 and the lower slide member 29 have been opened, a fitter can connect the pipe length 34 to be laid to the stretch of outfall piping 30 already laid, the end of which is located in the area of the fitting orifice 22. In order to prevent soil water from escaping at the free end of the outfall drain 30, it is recommendable to use a sealing cap or blind flange here until the next pipe length 32 (or a branch element, see below) is added. The outfall drains 30 and 30' are extended in sections in the manner described above until a house discharge pipe 36 is encountered.

A house discharge pipe 36, the exact position of which must be known, can be connected, with its outfall generally feeding in from above, into an outfall drain (in this instance outfall drain 30) by the following procedure: The end area of the house discharge pipe 36 which is still feeding into the old drain is severed using the cutting shoe 2. It is recommendable to apply a temporary seal to the now open end of the house discharge pipe 36, such as an inflatable bag. This will not only ensure that drainage water is prevented from flowing from the house discharge pipe 36 into the working area during connecting operations but also affords protection against soiling of the house discharge pipe 36, by earth for example. In many cases, the upper region of the house discharge pipe 36 and the pipework of the relevant building will have ample capacity to hold soil water, which means that circumstances may permit the connection work to be carried out without interrupting service of the building's drainage system at all. Alternatively, the house discharge pipe can be temporarily shut off from the building, for example by fitting a bag in the inspection chamber. During this work phase, the end of the house discharge pipe 36 is not yet accessible via the fitting orifice 22, but it can be reached through the front face of the cutting shoe 2, which is provided with orifices.

When the tunnelling shield 1 has driven further forward so that the end of the house discharge pipe 36 can be reached from within the fitting orifice 22 and once the upper slide member 28 and lower slide member 29 have been opened, a branch element 38 can be fitted, allowing connection with the stretch of outfall piping 30 already laid. The temporary seal can now be removed from the house discharge pipe 36 and, once the open end of the branch element 38 has been covered, the house discharge pipe 36 can be put back into full service. The outfall drain 30 is extended by adding pipe lengths 32 until the next house discharge pipe is reached.

As an alternative to outfall drain 30 or 30' made up of essentially rigid pipe sections 32, a flexible endless pipe may be used. This endless pipe must be flexible enough to be stored in the interior of the machine pipe 4 and bent back in the vicinity of the laying orifice 21 so that its free end is pointing away from the tunnelling direction, i.e. to the right in FIG. 1. After being passed through the open end of the protective casing 24, the free end is connected to the last fitted branch element 38 of a house discharge pipe 36. As the shield 1 tunnels further ahead, the flexible endless pipe is fed continuously through the laying orifice 21 and the open end of the protective casing 24 until the next house discharge pipe is reached. At that point, the flexible endless pipe has to be severed and connected with the corresponding branch element 38.

Once the main drain has been completed, the ends of the house discharge pipes have to be severed from outfall drains 30 and 30' and connected to the main drain by means of orifices in the wall of the main drain. This can be done from the interior of the main drain without having to disconnect the drainage systems in the affected buildings.

The outfall drains 30 and 30' can remain in the ground after construction work has been completed. Depending on the circumstances, they can be filled with a hydraulic medium. The cavity (which is small as a rule) between the outfall drains 30 or 30' and the adjacent ground or main drain can also be filled if necessary, possibly whilst the construction work is continuing.

We claim:

1. Method for keeping outfall drainage in service while constructing sewerage, wherein a main drain is laid in the position of an old drain or in a new line by pipe or shield tunnelling under closed or semi-open construction using a working pipe or shield (1) at the tunnelling end, wherein at essentially the same time as the working pipe or shield (1) is tunnelling, laying at least one outfall drain (30, 30') below ground through at least one working orifice (21, 22, 21', 22') in the working pipe or shield (1), so that the outfall drain (30, 30') lies alongside the main drain.

2. Method according to claim 1, wherein and the cavity required for the outfall drain (30, 30') is formed in the ground while the working pipe or shield (1) is tunnelling by means of a lateral protrusion (24, 24') on the working pipe or shield (1).

3. Method according to claim 2, wherein the outfall drain (30) is laid through a laying orifice (21) provided in the side wall (14) of the working pipe or shield (1), which is surrounded on the outside by a protective casing (24), which is closed in the tunnelling direction and is open in the direction opposite the tunnelling direction and which produces the cavity required in the ground for the outfall drain (30) as the working pipe or shield (1) tunnels forwards.

4. Method according to claim 1, wherein on reaching an existing feeder pipe (36), the feeder pipe (36) is severed from its current mouth and connected via a branch element (38) to the stretch of outfall drain (30) already laid, wherein at least some of the work required for this purpose is carried out from the interior of the working pipe or shield (1) through the working orifice (20).

5. Method according to claim 4, wherein the feeder pipe (36) is temporarily sealed for a time.

6. Method according to claim 1, wherein the outfall drain (30) is made up of essentially rigid pipe lengths (32) and is laid by adding the pipe length to be laid (34), with its front end pointing in the direction of tunnelling, through the working orifice (20) with its rear end against the stretch of outfall drain (30) already laid.

7. Method according to any one of claims 1 to 5, comprising the step of laying the outfall drain as flexible endless piping, bending back the endless pipe to be laid in the interior of the working pipe or shield (1) and feeding the endless pipe, with its free end pointing away from the tunnelling direction, through the working orifice (20) and connecting it onto the stretch of outfall drain (30) already laid.

8. Device for keeping outfall drainage in service while constructing sewerage, with a working pipe or shield (1) wherein a main drain is laid in the position of an old drain or in a new line by pipe or shield tunnelling under closed or semi-open construction using the working pipe or shield (1) at the tunnelling end, characterised in that the working pipe or shield (1) is provided with at least one working orifice (21, 22, 21', 22') for laying at least one underground outfall drain (30, 30') alongside the main drain from the interior of the working pipe or shield (1).

9. Device according to claim 8, wherein the working pipe or shield (1) is provided with a lateral protrusion (24, 24') for producing the cavity in the ground required for the outfall drain (30, 30') as the working pipe or shield (1) is tunnelling.

10. Device according to claim 9, wherein the working orifice (20) has a laying orifice (21) provided in the side wall (14) of the working pipe or shield (1), which is surrounded on the outside by a protective casing (24), which is closed in the tunnelling direction and open in the direction opposite the tunnelling direction and which is arranged in such a way as to produce the cavity in the ground required for the outfall drain (30) as the working pipe or shield (1) is tunnelling.

11. Device according to claim 10, wherein the laying orifice (21) is a slit running in the longitudinal direction of the working pipe or shield (1).

12. Device according to claim 10, wherein the working orifice (20) has a fitting orifice (22) provided in the side wall (14) of the working pipe or shield (1), which is adjacent to the end of the laying orifice (21) that faces away from the tunnelling direction.

13. Device according to claim 12, wherein the fitting orifice (22) can be closed.

14. Device according to claim 13, characterised in that the fitting orifice (22) can be closed by means of a double slide device (28, 29) mounted on the interior wall of the working pipe or shield (1) which can be moved transversely relative to the tunnelling direction.

15. Device according to claim 8, wherein the device has a shield (1), in which, between cutting shoe (2) and machine pipe (4), an essentially pipe-shaped laying device (3) having at least one working orifice (21, 22, 21', 22') is provided, which is movably joined to the cutting shoe (2) and machine pipe (4).

16. Device according to claim 8, wherein several working orifices (20, 20') are provided in the side wall (14) of the working pipe or shield (1) for laying two underground outfall drains (30, 30') on the two sides of the main drain.

* * * * *

UNITED STATES PATENT AND TRADEMARK OFFICE

CERTIFICATE OF CORRECTION

PATENT NO. : 5,743,676

DATED : April 28, 1998

INVENTOR(S) : Hans-Juergen, et al.

It is certified that error appears in the above-identified patent and that said Letters Patent is hereby corrected as shown below:

Column 3, line 32, delete "A-A" and insert -- 3 --.

Column 3, line 34, delete "B-B" and insert -- 4 --.

Signed and Sealed this

Ninth Day of February, 1999

*Attest:*

*Acting Commissioner of Patents and Trademarks*

*Attesting Officer*